United States Patent [19]

Small

[11] 4,376,702

[45] Mar. 15, 1983

[54] WASTE DISPOSAL APPARATUS

[76] Inventor: Stuart H. Small, Hjorung Veien 9, Oslo 3, Norway

[21] Appl. No.: 237,121

[22] PCT Filed: Jul. 1, 1980

[86] PCT No.: PCT/GB80/00111

§ 371 Date: Mar. 2, 1981

§ 102(e) Date: Feb. 12, 1981

[87] PCT Pub. No.: WO81/00102

PCT Pub. Date: Jan. 22, 1981

[30] Foreign Application Priority Data

Jul. 2, 1979 [GB] United Kingdom ..... 7922872

[51] Int. Cl.[3] ..... C02F 3/02

[52] U.S. Cl. ..... 210/201; 4/321; 210/218; 210/220; 210/251; 210/255; 210/258

[58] Field of Search ..... 210/195.3, 198.1, 199, 210/201, 202, 218, 220, 221.2, 255, 258, 262, 251, 169, 172; 4/316, 321, DIG. 12

[56] References Cited

U.S. PATENT DOCUMENTS

| | | | |
|---|---|---|---|
| Re. 26,931 | 7/1970 | Valdespino | 210/220 X |
| 2,380,465 | 7/1945 | Proudman | 210/220 X |
| 3,049,489 | 9/1962 | Ciabattari | 210/220 X |
| 3,206,178 | 9/1965 | Lamb | 210/220 X |
| 3,298,526 | 1/1967 | Valdespino et al. | 210/220 X |
| 3,343,677 | 9/1967 | Okada | 210/218 X |
| 3,477,949 | 11/1969 | Liljendahl | 210/220 X |
| 3,497,064 | 2/1970 | Valdespino | 210/220 X |
| 3,620,371 | 11/1971 | Valdespino | 210/195.3 X |
| 3,808,123 | 4/1974 | Neel | 210/218 X |
| 4,154,685 | 5/1979 | Marcotte | 210/255 |
| 4,155,851 | 5/1979 | Michael | 210/220 X |
| 4,199,828 | 4/1980 | Hellers | 4/321 |
| 4,238,338 | 12/1980 | Kinzer | 210/220 X |

FOREIGN PATENT DOCUMENTS

| | | |
|---|---|---|
| 847250 | 10/1939 | France . |
| 1429370 | 3/1978 | United Kingdom . |
| 1502552 | 3/1978 | United Kingdom . |

*Primary Examiner*—Robert H. Spitzer
*Attorney, Agent, or Firm*—Lawrence Rosen

[57] ABSTRACT

Waste disposal apparatus suitable for the collection of waste from a vacuum sewer system, which comprises a tank (1) having a waste inlet (2) and a waste outlet (10, 12) and means (4) for reducing pressure in the tank such that, in use, the waste inlet is above the level of waste in the tank and reduced pressure is maintained above the waste level and waste can thereby be drawn through the waste inlet, in which the tank further comprises an air inlet (6) through which air can be caused to pass into, and thereby cause aerobic digestion of, waste in the tank.

7 Claims, 7 Drawing Figures

Figure 2:
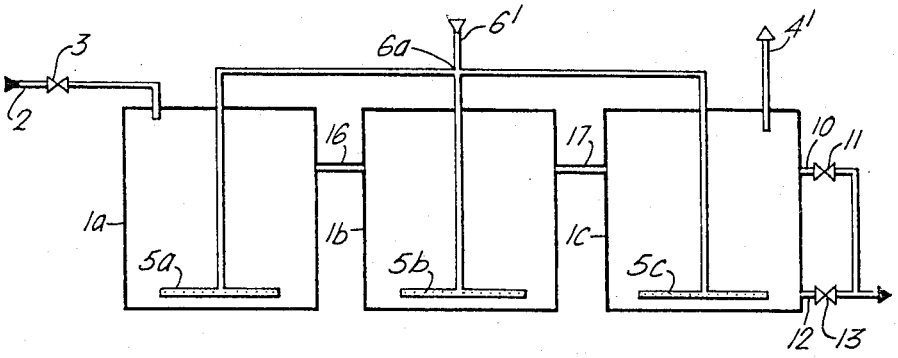

Fig. 1.
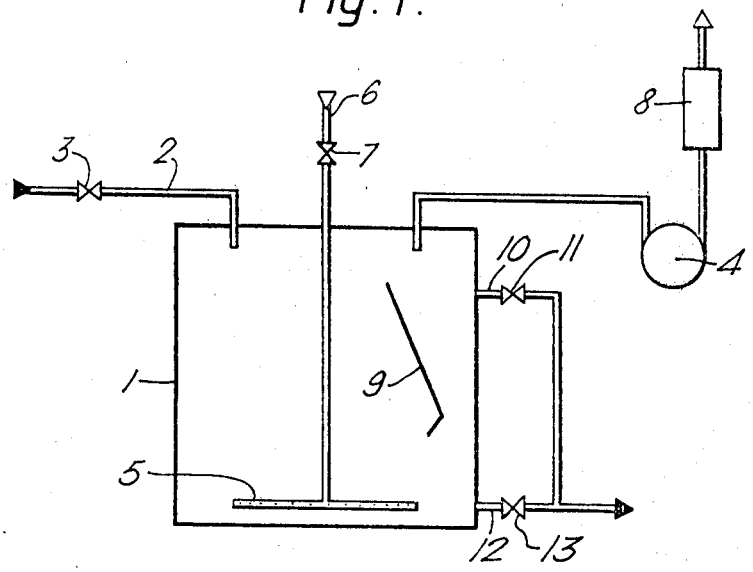
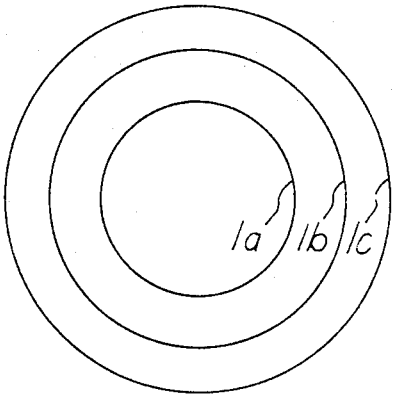
Fig. 7.

WASTE DISPOSAL APPARATUS

This invention relates to waste disposal apparatus of the type for use in conjunction with flushing lavatories where the waste is removed under vacuum. Such systems are widely used, particularly for domestic lavatories where there is no main supply of water. By removing the waste under vacuum, and using only sufficient water to rinse the lavatory bowl, vacuum-flushed lavatory systems use about 10% of the amount of water generally required in water-flushed lavatory systems.

Often, the waste from a vacuum-flushed lavatory passes into, and is stored in, a sealed tank to which a vacuum pump is attached. It will be appreciated that the tank must normally be sealed in order that a vacuum can be achieved above the level of waste. Accordingly, it has hitherto been necessary to empty the tanks periodically, say at intervals of six months, for example into a transport tanker.

During its residence time in a sealed collection tank, the waste will almost inevitably digest anerobically and turn septic. Particularly, on emptying there may be considerable odour. Further, it will be appreciated that the waste collection tank must be made sufficiently large to ensure that it can contain all the waste from the lavatory or lavatories of one or more homes between the times at which it is emptied.

While it is known to digest sludge aerobically, this has usually been done on secondary activated sludge, primary sludge, the material emptied from septic tanks and cesspits, or animal wastes. Such sludges have a high level of suspended solids, e.g. from 6000 to 20,000 mg/1.

It has been proposed to use an ejector pump as a means of causing the reduction in pressure necessary to flush a vacuum-flush lavatory. In the pump, the waste is entrained in a fast flow of fluid which inevitably includes oxygen. Therefore, a degree of aeration may occur in a collection tank into which the waste is passed, but this aeration is mainly limited, in practice, to the short and infrequent intervals when an associated lavatory is flushed and air is admitted to the vacuum sewer. Such a system suffers from the disadvantage that a considerable fluid pressure head is necessary for operation of the ejector pump. A further disadvantage is that the pressure at the outlet of the pump and in the collection tank is ambient, although it is usually convenient, and often necessary, to collect and store the waste under reduced pressure. Finally, the fact that the waste collection tank is at atmospheric pressure can cause odour problems. It is undesirable to use water as the fluid in such a system using an ejector pump since water is in short supply in exactly those places where vacuum-flushed systems are used and the water added to the waste in the pump means either large collection tanks or costly recycling apparatus. Such apparatus is needed when, as has been the case, the collected waste is recycled for use as the fluid forced through the pump.

Ejector pump systems are proposed in British Pat. Nos. 1,429,370 and 1,502,552 and U.S. Pat. No. 3,620,371, but in each case waste material is passed through the pump.

It would be desirable to provide waste disposal apparatus of the general type described which allowed controlled digestion of the waste from lavatories and other sources and which could eliminate the need for collection and separate disposal of the waste, or at least reduce the frequency of collections. It has been found that such an object can be achieved by simple modification of the most basic apparatus used for the collection of waste from a vacuum sewer system, in which the collection tank is maintained under vacuum. The reduced pressure which is maintained in the apparatus to operate the system is used to cause treatment of the collected waste. It has been found that, surprisingly, even under the reduced pressure, there need be no, or at most only minor, reduction in oxygen transfer.

According to the present invention, in such waste disposal apparatus comprising a tank having a waste inlet and a waste outlet, and means for reducing pressure in the tank such that, in use, the waste inlet is above the level of waste in the tank and reduced pressure is maintained above the waste level and waste can thereby be drawn through the waste inlet, the tank additionally comprises an air inlet through which air can be caused to pass into, and thereby cause aerobic digestion of, waste in the tank.

In use of the apparatus of the invention, waste is drawn into the tank under the influence of reduced pressure. This may be conducted in conventional manner, by opening a valve in a pipe between the, say lavatory and the apparatus when it is desired to flush the lavatory. The waste in the tank can then be aerated by means of the air drawn in through the air inlet, and the waste can also be mixed and disintegrated by this means.

Systems designed according to the present invention avoid the disadvantages associated with ejector pump systems. Existing vacuum flushed systems with collection tank maintained under vacuum can be modified to provide aerobic treatment and achieve mixing and attrition, without the need for modification of the pump.

Waste disposal apparatus designed according to the present invention can be engineered as vacuum systems throughout, to achieve the necessary degree of digestion of water and sludge for continuous discharge to the environment with or without separation and without breaking the vacuum. It has hitherto been conventional to operate a vacuum pump intermittently, using pressure sensing devices to start and stop the pump. This type of operation is inherently more complex and requires more maintenance than continuous operation. In addition, the pump has to be engineered to withstand the pressure differential pertaining during the periods when it is not operating. This generally requires the provision of some protective device, for example, a non-return check valve.

For these reasons, inter alia, it is advantageous that in systems designed according to the present invention, operation of the vacuum pump system is continuous and that the pump system combines the roles of providing the necessary vacuum for operating the vacuum sewer system and for collecting wastes with the simultaneous operation of a submerged aeration system for aerobic treatment of the collected wastes. It is also advantageous that the submerged aeration system is self-regulating, by the inclusion of a constant pressure vacuum-relief valve on the air inlet, so that two or more pumps can be brought into operation without the need for manual or other form of regulation.

Very importantly, as will be discussed in more detail below, the apparatus of the invention can be adapted to provide a sequence of treatment stages which can be used to provide, as may be desired, a very highly processed sludge and liquid mixture which may be suitable for disposal without separation on site.

In relation to conventional waste disposal apparatus operated in conjunction with a vacuum sewer system, the wastes involved in use of apparatus of the invention are so small in volume that it becomes possible to design for much longer digestion periods than is otherwise economically or practically feasible. This makes it feasible to digest a mixed liquor without introducing a separation stage with sludge return. The BOD level in the unseparated digested waste is brought to a satisfactory level for discharge by having a sequence of digestion stages, in which newly introduced wastes are prevented from becoming mixed with the partly digested wastes in the subsequent stages and the well-digested waste in the final stage.

It is believed that, owing to the greater relative difference between the pressure in the apparatus and ambient pressure, bubble formation and aeration may be enhanced. In bubble formation at depth in a liquid, the bubble breaks away when the internal pressure is slightly above the hydrostatic pressure at the point of formation. With reduced hydrostatic pressure, in the apparatus of the present invention, more bubbles are formed for a given amount of air, resulting in increased oxygen transfer surface.

The apparatus of the invention can be used in conjunction with any vacuum sewer system operated in conjunction with any suitable waste source, e.g. kitchen waste (optionally macerated), baths or showers. It is particularly suitable for use in conjunction with vacuum-flushed lavatories and the following description illustrates the invention with respect to this particular use.

In one embodiment of the invention, the apparatus is operated by continuously running a vacuum pump which maintains reduced pressure above the level of waste in a tank. When an associated lavatory is flushed, a valve on an inlet into the tank is opened and the waste from the lavatory is drawn into this tank through the inlet. An air inlet with a constant pressure vacuum relief valve and a submerged aerator allows the passage of air into the waste, causing mixing, attrition and aeration, under the influence of the vacuum above the waste level.

Usually, when there is only one collection/digestion tank, valved outlets from the tank for both solid and liquid wastes will be provided, the former near the bottom and the latter near the top of the tank. The valve on the liquid outlet, at least, can be replaced, if desired, by a column (tail-leg) of suitable height, the overflow of which can be discharged into a further tank where further digestion, aerobic or anaerobic, may be allowed. Before waste is bled off through a valve, it is necessary to break the vacuum. This can be conventionally programmed to occur during the night or when there is least likelihood of any associated waste source being used but, if desired, the system can be programmed to allow delayed flushing once the waste has been removed and the vacuum pump has been restarted.

It will often be desirable, particularly in larger systems, to extend the aeration path by providing a plurality of separate tanks or stages, although these may in effect be provided as separate compartments, e.g. concentric zones, in one tank, through which the waste passes in sequence. Air is drawn through one or more tanks before being discharged into the atmosphere. When the first compartment is filled to capacity with accumulated waste, an addition of an amount of fresh waste results in transfer of that amount of fully or partially digested material to the next compartment, where aeration is continued. Waste passed to the final compartment can thus be considered as nth stage waste (n being the number of compartments) with corresponding improvement in the standard of the water discharged from the system. In this way, no waste which has newly been added into the aeration tank can find its way immediately into the discharged effluent. In such a system, it will often be desirable to include means for transferring solid material from one stage to the next, thereby achieving fractionation or separation of materials within the system. The discharge of waste from a single digestion tank or the transfer of waste from one tank to another can be achieved by hydrostatic pressure differences or, in certain circumstances, by positive transfer.

It appears that the provision of a number of digestion stages in apparatus of the type to which this invention relates is inherently novel. Such an arrangement can have particular advantages when the first digestion stage, as in the first embodiment described above, is maintained at sub-ambient pressure. The sequence of tanks can be connected so that decreasingly reduced pressure is maintained in each tank in the sequence, the pressure in the final tank being substantially (i.e. approaching, or close to) ambient. In such a system, waste can be allowed to flow by displacement from one tank to the next in the sequence, and this can be allowed to happen continuously since, the final tank being substantially at ambient pressure, liquid at least can be allowed to flow out continuously. The height of a valveless tail-leg on the final stage in such a system can be much less than for a single stage. By connecting a vacuum pump to the first tank and the air inlet to the first tank to the second tank in the sequence above the waste level, and so on throughout the sequence, and allowing air to bleed into an inlet through the waste in the final tank, the waste travels in one direction through the sequence and air in the opposite direction. If desired, the waste may be transferred from tank to tank positively and/or there may be more than one vacuum pump assisting to maintain reduced pressure.

A desired sequence of hydrostatic pressures can be simply achieved in a sequence of tanks at successively lower levels, e.g. successively lower storeys of a building. Alternatively, decreasingly reduced pressure can be achieved by providing a "lock" in the waste transfer between the stages, such that either gases are removed from one tank and, if appropriate, passed into the waste in an earlier tank in the sequence, or, when the waste level in the one tank reaches a predetermined level, the waste is transferred, e.g. to the next tank (or discharged). Such a "lock" system may be used with only one digestion tank.

When apparatus of the invention comprises a sequence of tanks, equal presure may be maintained in them all. If the pressure-reducing means is connected to the final tank, it may assist the transfer or overflow from one tank to the next. Pipes connecting the tanks are open to the passage of air or, when the level of waste reaches that level, that waste. Such a system may be modified by connecting the outlet from one tank to the aerator in the next. The "aerator" can be constructed so that waste or gases can pass therethrough. It will be appreciated that the degree of waste digestion which is achieved in operating apparatus of the invention can be such that it is often unnecessary to provide separate liquid and solid transfer/discharge outlets.

Sequences of tanks of the type described can be modified by omitting an air inlet into one or more tanks, and allowing anaerobic digestion therein. Anaerobic digestion may be considered desirable, e.g. in denitrification of partially treated waste. A sequence of tanks can be adapted to effect a similar series of operations as has been used in the treatment of waste in a series of tanks operated at ambient pressure. For example, reduced pressure in an early tank in a sequence may be used to recycle waste from a later tank.

A sequence of tanks operated under sub-ambient pressure avoids the problems associated with a single tank at ambient pressure. This can be achieved in a space smaller than is often required for a conventional digestion system, for a given waste source. Despite the number of digestion stages, the apparatus can be employed using only one vacuum pump.

Apparatus of the invention comprising a sequence of tanks in which there is decreasingly reduced pressure has two important advantages. Firstly, because the final tank is at substantially ambient pressure, the waste outlet does not require control. Secondly, successive aerobic digestion stages can give the waste in the final tank high or the maximum dissolved air content, so that satisfactory flotation of that waste can be achieved by the simple expedient of pulling a vacuum, e.g. of up to 0.5 kg, in that final tank. Accordingly, apparatus of the invention can simulate an activated sludge process with separation.

When decreasingly reduced pressure is maintained in a sequence of tanks, the first tank in the sequence must withstand the highest vacuum. Accordingly, since this first tank must be constructed of the strongest material, it is preferably the tank with the smallest included volume. If the tanks are separate, it will then also contain the smallest amount of waste, but if the tanks are arranged concentrically, the first tank being at the centre of the arrangement, it is easily possible to achieve the desired effect with the same amount of waste in each tank. The stresses in the system are thereby minimised.

In any sequence of tanks in apparatus according to the invention, there will generally be no more than five, e.g. two, three or four, tanks.

Apparatus of the invention is suitable for use where there is a number of closely situated waste sources, e.g. for a number of houses, or in a ship.

The size of the vacuum pump for a system with several associated lavatories of other waste sources can be minimized by programming the flushing systems so that flushing takes place sequentially even when the, say, lavatories are used simultaneously. Again, running costs can be kept low by relating the operation of the vacuum/aeration to the number of uses of the waste sources in a given period.

It will often be desirable to add selected materials, such as active carbon, to the digestion tank in order to influence oxygen uptake and increase oxygen transfer efficiency, to increase biological growth and to improve the sedimentation characteristics. In the apparatus of the invention, it may be necessary to include means for macerating or otherwise dealing with, for example, toilet paper.

Besides the waste, air is also discharged. This will usually be passed through a filter element. The discharged sludge may be passed to a sludge drying bed, e.g. comprising a layer of sand supported on a wire or plastics mesh through which liquid can drain. The dried sludge may be used directly on a garden. Alternatively, the sludge may be passed through a bag filter comprising a filter sock through which liquid can drain. This can conveniently be operated in association with the vacuum pump for faster drying. After drying, the bag containing the solid waste can be disposed of as desired.

The invention will now be illustrated by way of example with reference to the accompanying drawings which are schematic representations of various embodiments of waste disposal apparatus according to the invention. In each case, the waste input and output are indicated by solid arrows, and the air input and output by outlined arrows. FIG. 7 shows only part of such apparatus.

In use of the apparatus shown in FIG. 1, waste is drawn into a digestion tank 1 from a lavatory (not shown) through a waste inlet 2 having a valve 3 (which is operated by the user of the lavatory) under the influence of reduced pressure maintained in the tank by vacuum pump 4. The sludge which collects at the bottom of the digestion tank is aerated by air which passes out of an aeration unit 5, having passed through an air inlet 6 having a bleed 7. Air which is pumped from the digestion tank via the pump 4 passes through a filter 8. In the tank shown, there is a decanter 9 (optional). When the vacuum is broken, liquid may be decanted through an outlet 10 having a valve 11 and sludge may be discharged through an outlet 12 having a desludge valve 13.

Figure 3:
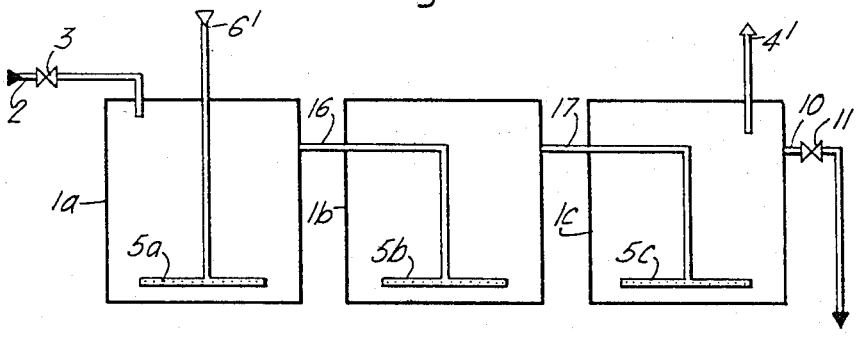

FIGS. 2 and 3 illustrate apparatus comprising a horizontal sequence of tanks 1*a*, 1*b* and 1*c*. In each embodiment, analogous to those items shown in FIG. 1, there are a waste inlet 2 and valve 3, aeration units 5*a*, 5*b* and 5*c*, a liquid waste outlet 10 and, in FIG. 2, a sludge outlet 12 and desludge valve 13 are shown. In addition, pipes 16 and 17 connect tank 1*a* to 1*b* and 1*b* to 1*c*, respectively. Air removal means, which may comprise a vacuum pump and an air filter, is connected at 4'. An air bleed inlet is shown generally at 6'.

The pressure is the same in each of the tanks 1*a*, 1*b* and 1*c* shown in FIGS. 2 and 3. The level of waste, which tends to equalise between the three tanks, cannot exceed the height of the outlet 10. The pressure-reducing means draws air through the aerators, but in different manner in each of the two embodiments. In FIG. 2, air is drawn in via manifold 6*a* to any or all of the aerators. Pipes 16 and 17 serve as simple overflow waste transfer means. In FIG. 3, air is drawn directly into tank 1*a*, and while the waste in that tank is below the level of pipe 16, into tank 1*b*, and so on. When the level of waste in tank 1*a* reaches the level of pipe 16, that waste is drawn into tank 1*b* via the same route. No solids outlet is illustrated in FIG. 3; depending on the degree of digestion, this can be omitted in other embodiments. However, in the apparatus of FIG. 3, it will often be desirable to prevent the transfer of undigested solids by the provision of a screen over the inlet to pipe 16.

Figure 4:
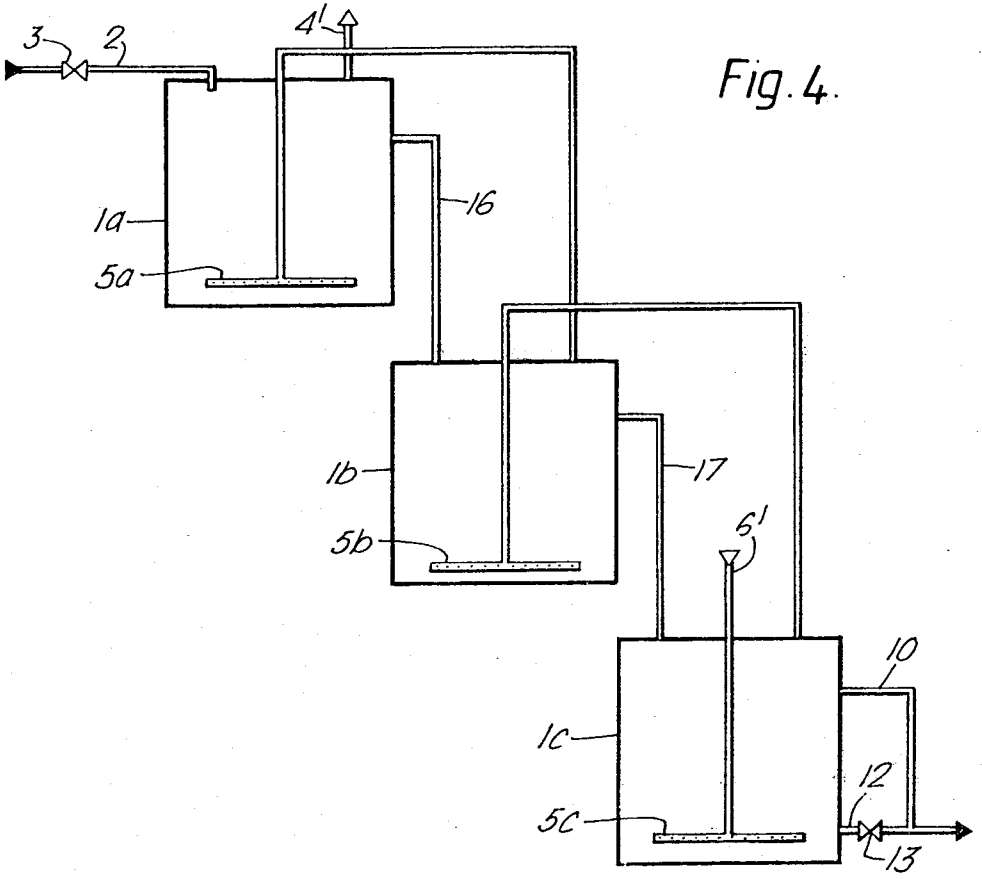

FIG. 4 shows apparatus having many of the same characteristics as that of FIGS. 2 and 3, using the same reference numerals for the same elements, except that the sequence of tanks is staggered vertically, giving a gradation of pressure in the tanks. The vacuum pump 4' is connected to the first tank and the air bleed 6' to the last; waste runs downhill and air in the opposite direction through aerator 5*a* from tank 1*b* and through aerator 5*b* from tank 1*c*. Alternatively, more than one vacuum pump may be provided, to balance aeration and vacuum operation regulation for different treatment process and treatment stages.

Figure 5:
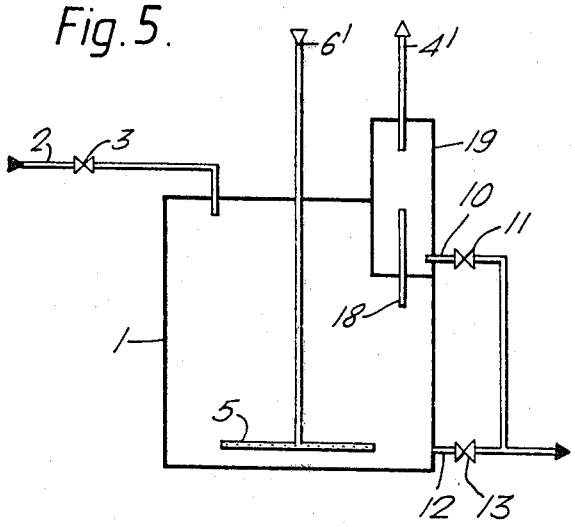
Figure 6:
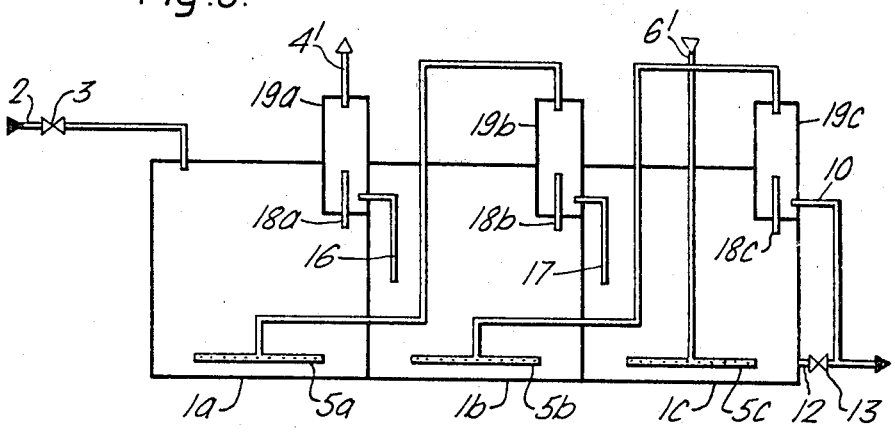

FIGS. 5 and 6 illustrate apparatus of the invention in which the means used to reduce pressure is also used to discharge waste and additionally, in FIG. 6, to transfer it from one tank to the next in a sequence of tanks. The reference numerals 1,2,3,4',5,6', 10,12,13,16 and 17 are used for the same parts as in the preceding drawings. In operation of the apparatus illustrated in FIG. 5, the means 4' used to reduce pressure removes air from above the level of waste through pipe 18 and thus causes aeration of the waste by drawing in air through the aerator 5. When the level of waste in the digestion tank reaches the lower end of the pipe 18, the pump or other means draws the waste up through the pipe into a collection tank 19 from which it can be discharged through outlet 10. The same principle is applied to a sequence of tanks in the apparatus illustrated in FIG. 6. The waste drawn up into the first collection tank 19*a* is discharged into the second tank 1*b* through pipe 16 and waste collected in the second collection 19*b* into the third digestion tank 1*c* through pipe 17. As in the embodiment illustrated in FIG. 4, the pressure at the final stage can be close to ambient.

In use of the apparatus illustrated in FIGS. 4 and 6, the degree of reduced pressure in the sequence of tanks is successively lower. If it is convenient, tank 1*a* (which has to withstand the highest vacuum) may be constructed of the strongest material. It may therefore be desirable for the various tanks to be of the same height (so that the waste level in each is comparable) but of different breadth and/or length so that the included volume is smallest for the first tank. FIG. 7 is a cross-sectional plan view of a concentric arrangement of cylindrical tanks 1*a*, 1*b* and 1*c* in which the first tank in the sequence still has the smallest included volume, but in which the volume of waste in each stage can be much the same. For such tanks, if the radii of tanks 1*a*, 1*b* and 1*c* are $R_a$, $R_b$ and $R_c$, respectively, they can each contain the same volume of waste if $$R_a^2 = R_b^2 - R_a^2 = R_c^2 - R_b^2$$

The tanks shown in FIG. 7 can be connected and fitted with the same elements as those shown in FIG. 6.

The apparatus illustrated in each of FIGS. 2, 3, 4, 6 and 7 shows three digestion stages. It will be appreciated that there can be two or four or more such stages. Further, one of the aerobic stages can be replaced by an anaerobic digestion stage. Morover, means can be provided for recycling waste from one tank to an earlier in the sequence. It will often be unnecessary to provide independent liquid and solid waste transfer or discharge means if the waste does not settle into two phases and, if the flotation principle, described above, is used in the final tank, it will be necessary to include in the apparatus a means of applying a vacuum in the final stage. This may be done by further exploiting a vacuum pump already in use or by using a further vacuum pump.

Oxygen transfer measurements have been conducted on apparatus of the type shown in FIG. 1 and, for comparison purposes, similar apparatus in which a compressor is used to push air in under pressure through the aerator. In this comparative, conventional, system, it is known that the mass transfer of oxygen to the water phase is dependent, not only on the pressure and temperature, but also on the presence of chemical compounds in the liquid. In order to obtain relative measurements for the comparison of various systems, it is common practice to carry out tests using sodium sulphite solution. Under these conditions, the oxygen level in solution is maintained at zero. While this is not exactly analagous to the situation in the aeration compartment of a sewage plant, this method has become accepted amongst manufacturers of aeration equipment.

In the experiments, the aerator or air diffuser was in the form of a cross with eight 5 mm diameter holes (2 per arm). Each arm was covered with Saran fabric having a mesh of 0.1 mm nominal section. This design is similar to the system used in many existing packaged sewage plants.

The aeration vessel had an overall height of 1,850 mm and was filled with water to a depth of 1,400 mm.

The test solution was prepared by adding approximately 1,000 grams of sodium bisulphite and 0.5 grams of cobalt chloride to the water in the aeration vessel (or 200 liters). The purpose of the cobalt salt was to act as a catalyst in the reaction between sulphite and oxygen.

In both series of tests, i.e. vacuum (460 mm Hg absolute) and pressure (760 mm Hg) aeration was carried out at 15° C. for a period of five hours. Samples of the test liquor were taken at the beginning of each test run and also throughout the run. Each sample was assayed for sulphite concentration using a standard iodometric titration and the total oxygen absorbed over the period computed. The efficiency of oxygen transfer was calculated as a percentage of the total oxygen used in the tests.

Values of 1.27% and 1.86%, relative to free air at 760 mm Hg, respectively, were obtained in the vacuum and pressure tests.

These results appear to show that the aeration efficiency under vacuum falls. This is, in absolute terms, correct, but when it is considered that the results as reported are those which are 'apparent' for design purposes it must be realised that, as the input pressure is reduced the efficiency will apparently fall, since the air input is calculated from the air volume applied. In the vacuum test, the air volume is free air at atmospheric pressure, whilst in the pressure test it is the air delivered at the test pressure.

The actual pressure for the pressure test was 910 mm Hg (abs). In the case of the vacuum test, the pressure at the aerator was 610 mm Hg. Thus, to a first approximation, the pressure test result of 1.86% would predict a value of $1.86 \times 610/910 = 1.25\%$ for the vacuum test.

Comparing this with the measured result of 1.27%, it can be seen that the error is only 2%. Thus it may be concluded that there is no effect of aerating under vacuum, except that which would be predicted, i.e. the use of more air relative to that required at normal pressures.

I claim:

1. Waste disposal apparatus suitable for the collection of waste from a vacuum sewer system, which comprises a tank having a waste inlet and a waste outlet, an air inlet, a separate liquid outlet near the top of the tank, and a single vacuum means for reducing pressure in the tank such that, in use, the waste inlet is above the level of waste in the tank and reduced pressure is maintained above the waste level and waste can thereby be drawn through the waste inlet, and such that, in use, the air inlet is below the level of waste in the tank, and air can be caused to pass into, and thereby cause aerobic digestion of, waste in the tank.

2. Apparatus according to claim 1 in which the pressure-reducing means is connected to the tank in a manner such that gases are removed from the tank or, when the waste reaches a predetermined level, the waste is transferred from the tank.

3. Apparatus according to claim 1 or claim 2 in which there is a plurality of tanks through which the waste can pass, in sequence.

4. Apparatus according to claim 3 in which the tanks are connected in a manner such that decreasingly reduced pressure can be maintained in each tank in the sequence, the pressure in the final tank being substantially ambient.

5. Apparatus according to claim 4 in which the first tank in the sequence has the smallest included volume.

6. Apparatus according to claim 5 in which the tanks are arranged concentrically, the first tank in the sequence being at the centre of the arrangement.

7. Apparatus according to claim 1 in association with a vacuum-flushed lavatory.

* * * * *